US007340073B2

(12) United States Patent
Fischer

(10) Patent No.: US 7,340,073 B2
(45) Date of Patent: Mar. 4, 2008

(54) HEARING AID AND OPERATING METHOD WITH SWITCHING AMONG DIFFERENT DIRECTIONAL CHARACTERISTICS

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 608 days.

(21) Appl. No.: 10/872,172

(22) Filed: Jun. 18, 2004

(65) Prior Publication Data

US 2005/0025325 A1 Feb. 3, 2005

(30) Foreign Application Priority Data

Jun. 20, 2003 (DE) ..... 103 27 890

(51) Int. Cl.
*H04R 25/00* (2006.01)
*H04R 3/00* (2006.01)

(52) U.S. Cl. ..... 381/313; 381/92; 381/119

(58) Field of Classification Search ..... 381/312, 381/313, 358, 94.5, 123, 119, 92; 700/94
See application file for complete search history.

(56) References Cited

U.S. PATENT DOCUMENTS 5,524,056 A 6/1996 Killion et al.
6,424,721 B1 7/2002 Hohn
7,103,191 B1 9/2006 Killion
2002/0034310 A1* 3/2002 Hou ..... 381/313
2002/0172379 A1* 11/2002 Cliff ..... 381/119
2002/0191805 A1 12/2002 Hagen et al.
2003/0072465 A1 4/2003 Fischer et al.

FOREIGN PATENT DOCUMENTS

DE 198 49 739 A1 5/2000
DE 199 48 907 A1 2/2001
DE 198 49 739 5/2001
DE 101 14 101 A1 6/2002
EP 0 982 971 3/2000
WO WO 00/72668 12/2000
WO WO 00/76268 12/2000
WO WO 01/01731 1/2001
WO WO 01/10169 2/2001
WO WO 01/69968 9/2001
WO WO 02/03750 1/2002
WO WO 02/28140 4/2002

* cited by examiner

*Primary Examiner*—Sinh Tran
*Assistant Examiner*—Walter F Briney, III
(74) *Attorney, Agent, or Firm*—Schiff Hardin LLP

(57) ABSTRACT

In a hearing aid having a microphone system composed of multiple microphone units, in order to avoid artefacts from being created when switching between different directional characteristics, the signal levels of microphone signals that respectively originate from different microphone units with different-order directional characteristics are matched with regard to a reference signal. The switching or superimposition is then always carried out between microphone signals with the same signal level, so that the switching or superimposition does not result in any sudden level changes.

11 Claims, 2 Drawing Sheets

HEARING AID AND OPERATING METHOD WITH SWITCHING AMONG DIFFERENT DIRECTIONAL CHARACTERISTICS

BACKGROUND OF THE INVENTION

1. Field of the Invention

The present invention relates to a method for operation of a hearing aid having a microphone system, a signal processing unit and an output transducer, wherein the microphone system has at least two microphone units from which microphone signals originate and which have different-order directional characteristics, and wherein the directional characteristic of the microphone system is variable during operation of the hearing aid. The invention also relates to a hearing aid for Implementing the method.

2. Description of the Prior Art

Modern hearing aids make use of devices for classification of hearing situations. The transmission parameters of the hearing aid are varied automatically depending on the hearing situation. In the process, the classification may influence, inter alia, the method of operation of the interference noise suppression algorithms, and the microphone system. First, as an example, a choice is made on the basis of the identified hearing situation (discretely switched or continuously superimposed) between an omnidirectional directional characteristic (zero-order directional characteristic) and considerable directionality of the microphone system (first order or higher order directional characteristic). The directional characteristic is produced by using gradient microphones or by electrically interconnecting two or more omnidirectional microphones. Microphone systems such as these have a frequency-dependent transmission response, which is characterized by a considerable drop at low frequencies. The noise response at the microphones is also independent of frequency, and is slightly amplified in comparison to an omnidirectional microphone In order to achieve a natural sound impression, the high-pass frequency response of the microphone system has to compensate for this by amplification of the low frequencies. The noise that is present in the low frequency range likewise is amplified in the process and in some circumstances is clearly audible in a disturbing manner, with quieter sounds being concealed by the noise.

German OS 198 49 739 discloses a hearing aid having at least two microphones forming a directional microphone system. In order to avoid undesirable corruption of the directional microphone characteristic resulting from microphones that are not matched to one another, characteristic values of the signals from both microphones are detected by a comparison element, a control element and an actuating element, and are matched to one another in the event of any discrepancy.

PCT Application WO 00/76268 discloses a hearing aid having a signal processing unit and at least two microphones, which can be interconnected to form different order directional microphone systems, in which case the directional microphone systems can themselves be interconnected with a weighting that is dependent on the frequency of the microphone signals emitted from the microphones. The cut-off frequency between adjacent frequency bands in which different weighting of the microphone signals is provided can be adjusted as a function of the result of signal analysis.

European Application 0 942 627 discloses a hearing aid having a directional microphone system with a signal processing device, an earpiece and two or more microphones, the output signals of which can be interconnected via delay elements and the signal processing device with different weighting in order to produce an individual directional microphone characteristic. The preferred reception direction (main direction) can be adjusted individually in the directional microphone system for matching to the existing hearing situation.

U.S. Pat. No. 5,524,056 discloses a hearing aid having an omnidirectional microphone and a first order or higher order directional microphone. The amplitude of the microphone signal from the directional microphone is amplified in the low signal frequency range, and is matched to the microphone signal from the omnidirectional microphone. To produce a frequency response that is as linear as possible, an equalizer is provided in the microphone signal path from the directional microphone, and raises the microphone signal in the lower frequency range. Both the microphone signal from the omnidirectional microphone and the microphone signal from the directional microphone are supplied to a switching unit. The omnidirectional microphone is connected to a hearing aid amplifier when the switching unit is in a first switch position, and the directional microphone is connected to a hearing aid amplifier when the switching unit is in a second switch position. The switching unit can switch automatically as a function of the signal level of a microphone signal.

One disadvantageous feature of the known hearing aids with a directional microphone system is that, when switching between different directional characteristics of the microphone system or when a rapid transition takes place from one directional characteristic to another, this results in sudden level changes and thus artefacts.

SUMMARY OF THE INVENTION

An object of the present invention is to avoid artefacts in a hearing aid when rapid changes take place in the directional characteristic of the microphone system.

This object is achieved in accordance with the invention by a method for operation of a hearing aid having a microphone system, a signal processing unit and an output transducer, wherein the microphone system has at least two microphone units, from which microphone signals originate and which have different-order directional characteristics, and wherein the directional characteristic of the microphone system is variable during operation of the hearing aid, and wherein the signal level of the microphone signal which originates from the microphone unit is matched to the signal level of a reference signal.

In accordance with the invention a hearing aid for implementing the method having a microphone system, a signal processing unit and an output transducer, wherein the microphone system has at least two microphone units from which microphone signals originate and which have different-order direction characteristics, and wherein the directional characteristic of the microphone system is variable during operation of the hearing aid, and a unit for matching the signal level of at least one microphone signal which originates from a microphone unit to the signal level of a reference signal.

The hearing aid according to the invention has a microphone system with at least two microphones, in order to make it possible to produce zero order and first order directional characteristics. More than two microphones, however, preferably provided are used, so that it is also possible to produce second order and higher order directional characteristics. Furthermore, the hearing aid has a signal processing unit for processing and frequency-dependent amplification of the microphone signal that is produced by the microphone system. The signals are normally output in the form of an acoustic output signal by means of an earpiece. Other types of output transducers are also known, for example transducers, which produce vibration.

The term "zero order directional characteristic" as used herein means an omnidirectional directional characteristic, which is produced, for example, by a single omnidirectional microphone, which is not connected to any other microphones. A microphone unit having a first order directional characteristic (first order directional microphone) may be formed, for example, by a single qraded microphone or by the electrical interconnection of two omnidirectional microphones. First order directional microphones allow a theoretically achievable maximum value of the directivity index (DI) of 6 dB (hyperkidney) to be achieved. In practice, with the microphones optimally positioned and the signals that are produced by the microphones being matched as well as possible, DI values of 4-4.5 dB have been obtained on the KEMAR (a standard research dummy). Second order and higher order directional microphones have DI values of 10 Db or more, which are advantageous, for example, in order to allow speech to be understood better. If a hearing aid contains a microphone system with, for example, three omnidirectional microphones, then microphone units with zero order to second order directional characteristics can be produced at the same time on this basis by suitable interconnection of the microphones.

A single omnidirectional microphone intrinsically represents a zero order microphone unit. If, when two omnidirectional microphones are used, the microphone signal from one microphone is delayed, inverted and added to the microphone signal from the other microphone, then this results in a first order microphone unit. If the microphone signal from one microphone unit in two first order microphone units is once again delayed, inverted and added to the microphone signal from the second first order microphone unit, this results in a microphone unit with a second order directional characteristic. This allows microphone units of any desired order to be produced, depending on the number of omnidirectional microphones.

If the microphone system has microphone units of different order, then it is possible to switch between different directional characteristics, for example by connection or disconnection of one or more microphones. Furthermore, any desired mixed forms between the directional characteristics of different order also can be produced by suitable electrical interconnection of the microphone units. For this purpose, the microphone signals from the microphone units are weighted differently and are added before they are processed further and amplified in the hearing aid signal processing unit. This makes it possible to provide a continuous, smooth transition between different directional characteristics, thus making It possible to avoid disturbing artefacts during switching.

Frequently, however, there is no point in a gradual transition between different directional characteristics, for example when the object is to react to interference noise that starts suddenly. To suppress this, it is necessary either to carry out "hard" switching, or to carry out superimposition very quickly. In conventional hearing aids, this results in disturbing artefacts being produced.

In the hearing aid according to the invention, the signal levels of the microphone signals, which originate from different-order microphone units are advantageously matched. This makes it possible to switch between the microphone signals and to quickly change the weighting of the individual microphone signals when two or more microphone signals are being processed at the same time, without the process causing sudden level changes, and artefacts associated therewith. A sudden change in the directional characteristic may be caused, for example, by switching to a different hearing program. In this case, the program change may be initiated not only manually but also by the hearing aid on the basis of automatic situation identification. A rapid change in the directional characteristic takes place in particular when the hearing aid identifies interference noise that occurs suddenly. If, for example, during the "conversation" hearing situation, interference noise which starts suddenly is detected from the side or from behind by the omnidirectional microphone, then switching takes place to the directional microphone pointing forwards, and/or the weight of the microphone signal which originates from the directional microphone Is increased in comparison to the weight of the microphone signal which originates from the omnidirectional microphone.

To avoid sudden level changes during switching or in the event of a rapid change in the directional characteristic in a hearing aid according to the invention, the signal levels of the microphone signals which originate from different-order microphone units are normalized. For example, the signal level from an omnidirectional microphone is used as a reference signal. Preferably, however, the signal level from a directional microphone and, in particular, the signal level from the directional microphone with the greatest directionality is used as the reference signal. The signal levels of the microphone signals which originate from the different microphone units are matched to the signal level of the reference signal. When switching between different microphone units or in the event of a change in the weighting of the microphone signals, with the sum of the weights preferably always equals unity, this always results in a transition between microphone signals with the same signal level. Sudden level changes caused by a change to the directional characteristic and switching artefacts resulting from them, are thus avoided.

In modern hearing aids, the microphone signal to be processed normally is fist subdivided into frequency bands. In one embodiment according to the invention, the output signals from the individual microphones are first subdivided into individual frequency bands. The microphone signals in the individual frequency bands are interconnected to produce microphone units with different-order directional characteristics. In another embodiment of the invention microphone units have different directional characteristics in order subsequently to subdivide the output signals from these microphone units into frequency bands. The different weightings of the microphone signals from the different-order microphone units, which are dependent on the frequency, or the switching between different orders then advantageously takes place in these frequency bands. In this case, both the weights of the microphone signals from different microphone units in one frequency band and the weights of the microphone signals which originate from a microphone unit in different frequency bands can be adjusted independently of one another. In the hearing aid according to the invention, the signal levels also can be normalized in the individual frequency bands. The procedure is in principle the same as for the already-described matching of the signal levels of the microphone signals which originate from different microphone units. The only difference is that the matching is not carried out over the entire bandwidth of the acoustic input signal, but is restricted to only one frequency band. The matching process preferably is carried out in parallel in all of the frequency bands into which the input signal to be processed is subdivided.

The invention can be used with all known hearing aid types having a directional microphone system, for example with hearing aids worn behind the ear, hearing aids worn in the ear, implantable hearing aids or pocket hearing aids. Furthermore, the hearing aid according to the invention may also be part of a hearing aid system that has two or more appliances for assisting a hearing-impaired person, for example part of a hearing aid system with two hearing aids which are worn on the head for binaural supply, or part of a hearing aid system having an appliance which can be worn on the head and a processor unit which can be worn on the body.

DESCRIPTION OF THE PREFERRED EMBODIMENTS

Figure 1:
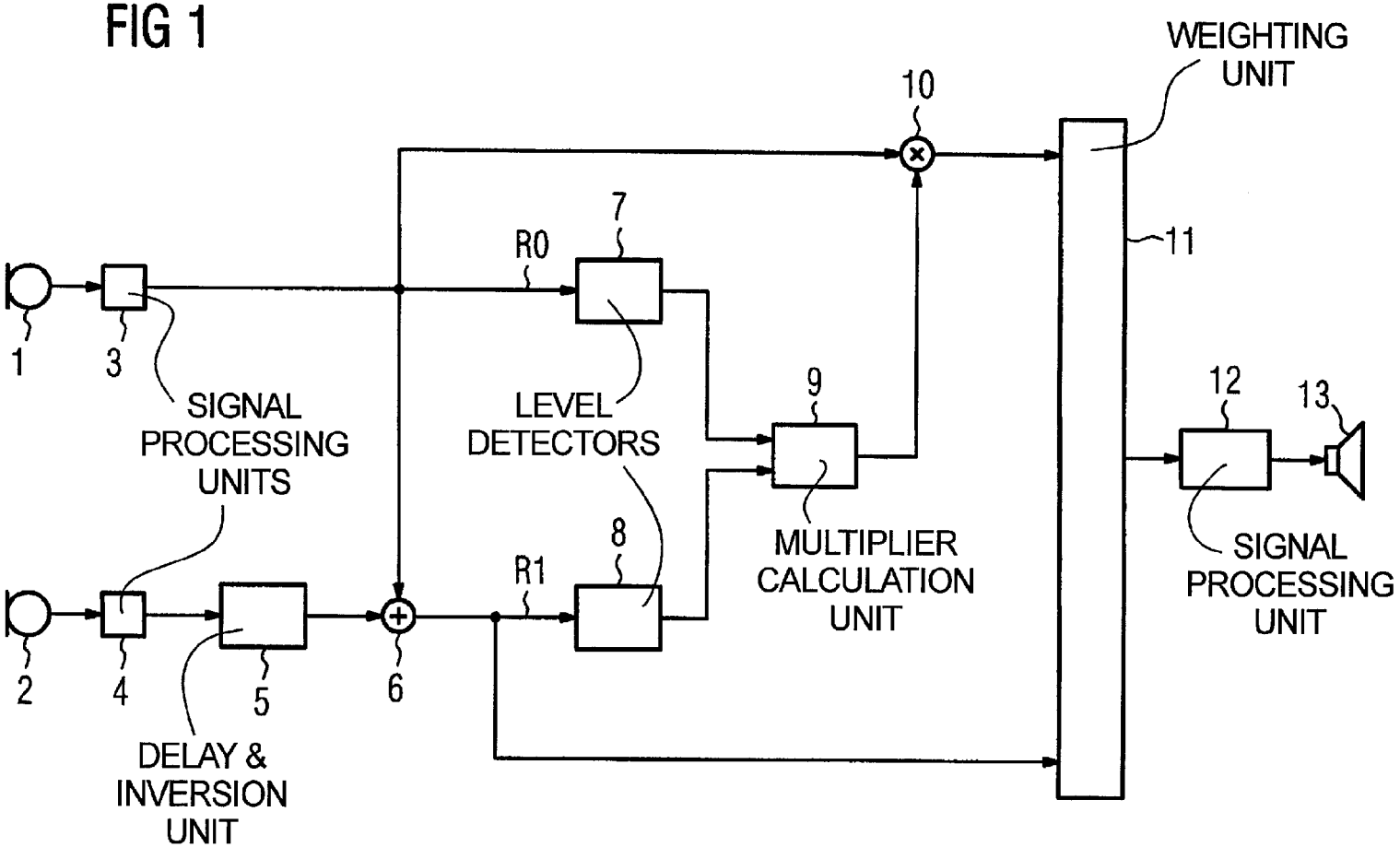
FIG. 1 is a block diagram of a hearing aid having a microphone system, in which matching of the signal level of the microphone signals which are produced by microphone units having a different-order directional characteristic is provided in accordance with the invention.

FIG. 1 shows a simplified block diagram of a hearing aid having two omnidirectional microphones 1 and 2. The microphone signals produced by the microphones 1 and 2 are first supplied to respective signal pre-processing units 3 and 4 wherein, for example, pre-amplification and A/D conversion of the electrical output signals from the microphones is undertaken. Delaying and inverting of the microphone signal produced by the omnidirectional microphone 2 take place in the delay and inversion unit 5, followed by addition to the microphone signal, R0 that originates from the microphone 1 in the adder 6. This results in the microphones 1 and 2 forming a directional microphone unit 1, 2 with a first-order directional characteristic, from which the microphone signal R1 is produced. According to the invention, level detectors 7 and 8, respectively, by means of which the signal levels of the respective microphone signals R0 and R1 are determined, are connected in the respective microphone signal paths of the microphone 1 and the microphone unit 1, 2 that is formed from the microphones 1 and 2. The signal levels determined in this way are used in the multiplier calculation unit 9 to calculate a multiplier, that matches the signal level of the microphone signal R0 that originates from the omnidirectional microphone 1 to the signal level of the directional microphone unit 1, 2 which is formed from the microphones 1 and 2. The microphone signal R0 that originates from the microphone 1 is multiplied by the calculated factor in a multiplier 10. In order to match the two microphone signals R0 and R1, the factor is calculated from the quotient of the signal level of the microphone signal R1, as produced by the directional microphone 1, 2, in the numerator, and the signal level of the microphone signal R0, as produced by the omnidirectional microphone 1, in the denominator. Depending on the selected hearing program or the respective environmental situation, the microphone signal R1 from the microphone unit 1, 2 that is formed from the microphones 1 and 2 and the microphone signal R0 from the omnidirectional microphone 1 multiplied by the calculated factor are weighted differently, and are added, in the weighting unit 11. The sum of the weights preferably always equals unity. The matching (normalization) of the microphone signals R0 and R1 according to the invention allows the directional characteristic to be changed rapidly without this resulting in the production of sudden level changes, and thus audible artefacts. Finally, the output signal from the weighting unit 11 is supplied to a signal processing unit 12 for further processing and for frequency-dependent amplification. The processed signal is then converted back to an acoustic signal by an earpiece 13, and is emitted into the auditory channel of a hearing aid wearer.

The described hearing aid offers the advantage that a shift in the weights in the weighting unit 11, or hard switching, can take place to rapidly change between different directional characteristics without in the process causing sudden level changes and audible distortion, associated therewith, as a result of the change to the directional characteristic.

Figure 2:
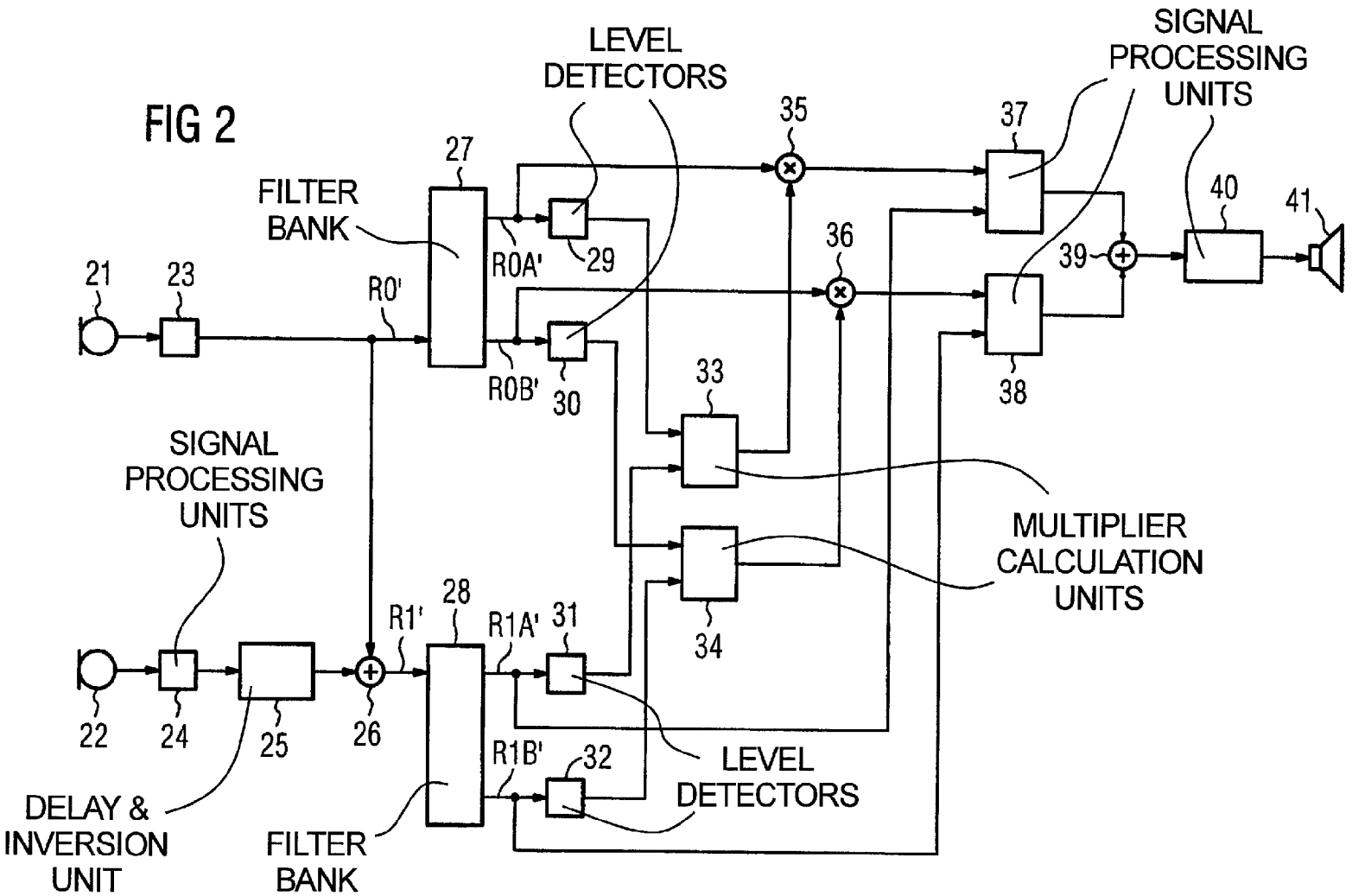
FIG. 2 is a block diagram of a hearing aid in which, in comparison to the hearing aid shown in FIG. 1, the microphone signals are also subdivided into frequency bands (channels) in accordance with the invention.

FIG. 2 shows another exemplary embodiment of the invention. Once again, this exemplary embodiment has a microphone system with two omnidirectional microphones 21 and 22. Signal pre-processing of the relevant microphone signal, for example preamplification and A/D conversion, is carried out in each of the two signal pre-processing units 23 and 24, and the microphone signal that is produced by the microphone 22 is delayed and inverted in a delay and inversion unit 25, and is added in the adder 26 to the microphone signal R0' from the microphone 21, thus resulting in the microphone signal R1'. As a consequence, both the microphone signal R0' originating from the omnidirectional microphone 21 and the microphone signal R1' produced by the directional microphone unit 21, 22 are available for further processing. In contrast to the situation in the previous exemplary embodiment, the microphone signals are, however, now subdivided into frequency bands, although, in order to make the illustration clearer, the exemplary embodiment is based only on subdivision in each case into two frequency bands. Subdivision into eight or more frequency bands normally issued in practice for hearing aids. In order to subdivide it, the microphone signal R0' is supplied from the omnidirectional microphone 21 to a filter bank 27, and the microphone signal R1' from the directional microphone unit 21, 22 is supplied to a filter bank 28. The filter bank 27 produces the microphone signals R0A' as well as R0B', and the filter bank 28 produces the microphone signals R1A' as well as R1B'. The outputs from the filter banks 27 and 28 are each connected to a level detector 29, 30, 31, 32. The signal levels of the relevant microphone signals R0A', R0B' and R1A', R1B' are determined in the respective frequency band in the level detectors 29, 30, 31, 32. The signal level of the microphone signal R0' from the omnidirectional microphone 21 is then matched to the signal level of the microphone signal R1' from the directional microphone unit 21, 22 in the respective frequency band. In this case as well, the factor required for matching for the respective frequency band is obtained from the quotient of the signal level of the microphone signal R1A' or R1B' from the directional microphone 21, 22 in the numerator, and the signal level of the microphone signal R0A' or R0B' from the omnidirectional microphone 21 in the denominator, Multiplier calculation units 33 and 34 are provided in order to determine the respective matching factors. The respective microphone signals R0A' and R0B' are then multiplied by the calculated factor in respective multipliers 35 and 36. The (normalized) amplifying signals, which have been matched for the respective frequency band, are, finally, supplied to respective signal processing units 37 and 38, in which the microphone signals are weighted differently and are added, and/or in which switching takes place between the different microphone signals. Frequency-dependent further processing and amplification of the microphone signals in order to compensate for the individual hearing loss of a hearing aid wearer can also advantageously be carried out in the signal processing units 37 and 38. Finally, the separate frequency channels are joined together again in the adder 39, whose output signal is supplied to a signal processing unit 40 in which, for example, output signal amplification A/D conversion are carried out. In this exemplary embodiment as well, the electrical output signal is converted to an acoustic output signal in an earpiece 41.

In summary, in the case of a hearing aid having a microphone system, the aim is to avoid the production of artefacts when switching between different directional characteristics. To this end, the invention provides for the signal levels of microphone signals which originate from microphone units with different-order directional characteristics to be matched. The switching or superimposition is then always carried out between microphone signals at the same signal level, so that the switching or superimposition does not result in any sudden level changes.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for operating a hearing aid having a microphone system formed by at least two microphone units, respective signal processing units for said microphone units, and an output transducer for converting a signal derived from output signals of said processing units into an audio signal, said method comprising the steps of:

in each of said at least two microphone units, generating a microphone signal having a directional characteristic, the respective microphone signals having different-order directional characteristics that are variable during operation of the respective microphone units, each microphone signal having a signal level; and matching the respective signal levels to a signal level of a reference signal before converting said signal derived from output signals of said processing units into said audio signal.

2. A method as claimed in claim 1 comprising employing one of said microphone signals as said reference signal.

3. A method as claimed in claim 2 wherein at least one of said at least two microphone units is an omnidirectional microphone, and employing the signal level of the microphone signal of said omnidirectional microphone as a basis for said reference signal.

4. A method as claimed in claim 2 wherein at least one of said at least two microphone units is an directional microphone, and employing the signal level of the microphone signal of said directional microphone as a basis for said reference signal.

5. A method as claimed in claim 1 wherein said at least two microphone units include a plurality of directional microphone units, with one of said directional microphone units having a highest achievable directional characteristic order, and comprising employing the signal level from said one of said directional microphone units as a basis for said reference signal.

6. A method as claimed in claim 1 comprising matching each of the respective signal levels of the microphone signals from said at least two microphone units to the signal level of the reference signal by differently weighting the microphone signals from the respective microphone units with different weights, to obtain weighted signals, and adding said weighted signals.

7. A method as claimed in claim 6 comprising employing weights as said different weights that always add to unity.

8. A method as claimed in claim 1 comprising employing the microphone signal from one of said at least two microphone units as said reference signal, and determining a multiplication factor for multiplying the microphone signal from another of said at least two microphone units for matching said microphone signal from said another of said microphone units to said microphone signal from said one of said microphone units used as said reference signal.

9. A method as claimed in claim 1 comprising subdividing each of the microphone signals from said at least two microphone units into a plurality of frequency bands, and wherein said reference signal has a signal level in each of said frequency bands, and comprising, in each of said frequency bands, matching the signal level of the respective microphone signals to the signal level of the reference signal in that frequency band.

10. A hearing aid comprising:

a microphone system formed by a plurality of microphone units respectively having different-order directional characteristics that are variable during operation of the respective microphone units, each of said at least two microphone units producing a microphone signal having a signal level;

a matching circuit connected to said at least two microphone units and supplied with said microphone signals for matching the signal level of the microphone signal from at least one of said microphone units to a signal level of a reference signal, thereby producing a matched signal;

a signal processor supplied with said matched signal and at least one of said microphone signals for generating a processed signal therefrom; and an earphone supplied with said processed signal for converting said processed signal into an audio output signal.

11. A hearing aid as claimed in claim 10 comprising, for each of said microphone units, a level measurement device connected to the microphone unit for determining the signal level of the microphone signal from that microphone unit;

a multiplier calculation unit supplied with said signal levels from said level measurement devices for calculating a multiplication factor therefrom; and a multiplier supplied with one of said microphone signals and with said multiplication factor for multiplying said one of said microphone signals by said multiplication factor.

* * * * *